US008766074B1

(12) United States Patent
Flores

(10) Patent No.: US 8,766,074 B1
(45) Date of Patent: Jul. 1, 2014

(54) STAND FOR MUSICAL DRUM

(71) Applicant: Marcial Flores, Valencia, CA (US)

(72) Inventor: Marcial Flores, Valencia, CA (US)

( * ) Notice: Subject to any disclaimer, the term of this patent is extended or adjusted under 35 U.S.C. 154(b) by 0 days.

(21) Appl. No.: 13/694,967

(22) Filed: Jan. 23, 2013

(51) Int. Cl.
*G10D 13/04* (2006.01)
*G10D 13/02* (2006.01)
*G10G 5/00* (2006.01)

(52) U.S. Cl.
CPC ..... *G10D 13/026* (2013.01); *G10D 13/02* (2013.01); *G10D 13/04* (2013.01); *G10G 5/00* (2013.01)
USPC ..... 84/421; 84/419

(58) Field of Classification Search
CPC ..... G10D 13/026; G10D 13/02; G10D 13/04; G10G 5/00
USPC ..... 84/421, 419; 248/97, 99
See application file for complete search history.

(56) References Cited

U.S. PATENT DOCUMENTS

| | | | | | |
|---|---|---|---|---|---|
| 1,021,328 | A | * | 3/1912 | Noll | 248/312 |
| 1,837,637 | A | * | 12/1931 | Walberg | 84/421 |
| 2,140,995 | A | * | 12/1938 | Groom et al. | 248/97 |
| 3,095,172 | A | * | 6/1963 | Dwyer | 248/97 |
| 3,608,418 | A | * | 9/1971 | Chaffee et al. | 84/419 |
| 3,614,041 | A | * | 10/1971 | Koger | 248/97 |
| 3,747,463 | A | * | 7/1973 | Hinger | 84/419 |
| 4,099,441 | A | * | 7/1978 | Landon | 84/327 |
| 4,157,801 | A | * | 6/1979 | Elmer | 248/97 |
| 4,488,697 | A | * | 12/1984 | Garvey | 248/101 |
| 4,616,551 | A | * | 10/1986 | Bookvich | 84/411 A |
| 4,759,518 | A | * | 7/1988 | Yardas | 248/97 |
| 4,946,118 | A | * | 8/1990 | Hastings | 248/97 |
| 5,393,023 | A | * | 2/1995 | Callan | 248/97 |
| 5,645,253 | A | * | 7/1997 | Hoshino | 248/181.1 |
| 5,852,250 | A | * | 12/1998 | Cha | 84/327 |
| 6,040,514 | A | * | 3/2000 | Liao | 84/421 |
| 6,520,457 | B1 | * | 2/2003 | Yardley et al. | 248/99 |
| 6,559,365 | B2 | * | 5/2003 | Wilfer | 84/327 |
| 7,284,732 | B1 | * | 10/2007 | Lopa | 248/99 |
| 7,572,967 | B2 | * | 8/2009 | Meinl | 84/421 |
| 7,588,228 | B2 | * | 9/2009 | May | 248/436 |
| 7,858,859 | B2 | * | 12/2010 | Bassam | 84/421 |
| D670,883 | S | * | 11/2012 | Poubouridis | D34/5 |
| 2002/0011141 | A1 | * | 1/2002 | Meinl | 84/421 |
| 2003/0126972 | A1 | * | 7/2003 | Sato | 84/421 |
| 2004/0051021 | A1 | * | 3/2004 | Micheel | 248/346.01 |
| 2004/0139838 | A1 | * | 7/2004 | Stevens | 84/327 |
| 2011/0240807 | A1 | * | 10/2011 | Moberly | 248/176.3 |

FOREIGN PATENT DOCUMENTS

| | | | |
|---|---|---|---|
| GB | 273173 | A * | 6/1927 |

* cited by examiner

*Primary Examiner* — David Warren
*Assistant Examiner* — Christina Russell
(74) *Attorney, Agent, or Firm* — Beaumont Gitlin Tashjian; Larry F. Gitlin

(57) ABSTRACT

A musical drum support stand which supports a musical drum and suspends it off the ground or floor surface. The support stand includes a base section that defines an opening and a first member typically ring-shaped and a spaced-apart second member also typically ring-shaped situated below the first member. A plurality of spaced-apart brace support members are provided to join the first member to the second member with each of the brace support members being alternatively curved in concave-convex relation and adapted for detachably receiving and securely gripping the drum shell's base section and holding it in suspension off the ground.

9 Claims, 7 Drawing Sheets

STAND FOR MUSICAL DRUM

FIELD OF THE INVENTION

The present invention relates generally to the field of musical instruments and, more particularly, to a new and improved support stand for a musical drum.

DESCRIPTION OF THE PRIOR ART

Drum stands, risers and lifters for musical drums are well known in the prior art. These devices, which are employed to hold and stabilize drums while they are played, can be adjustable to accommodate drums of various shapes and sizes and enable the drummer to be orientated relative to the position of the drummer to give maximum effect to the drum's percussion capabilities. For example, lifters and risers enable a drum, like a conga or a djembe, to be held off the ground or floor surface to allow for a more rich or resonant drum sound. Some examples of drum stands, lifters, and risers in the prior art are, as follows: U.S. Pat. No. 1,837,637 issued Dec. 22, 1931 to B.E. Walberg teaches a stand for holding a snare drum that is foldable for ease of transporting; U.S. Pat. No. 6,040,514 issued Mar. 21, 2000 to Liao teaches a drum stand for use while sitting or kneeling comprising a base and radially projecting arms that can accommodate the bottom rims of drum shells of varying sizes; U.S. patent application filed on behalf of the inventor Sato (Pub. No. 2003/0126972A1 dated Jul. 10, 2003) teaches a more conventional drum stand with three support arms with the improvement that enables the softening of the impact on the drummer's wrists while beating on the drum; U.S. patent application filed on behalf of the inventor Michael (Pub. No. 2004/0051021A1 dated Mar. 18, 2004) teaches a collapsible drum stand that is adjustable to accommodate conga drums of different sizes and enables its use for stand up and sit down play; U.S. Pat. No. 7,572,967 B2 issued Aug. 11, 2009 to Meinl teaches a drum stand with a supporting ring having three attachments for supporting the drum shell above the ring and corresponding integrally formed legs provided as a stand below the ring.

Other examples of the prior art include a product that is marketed by Meinl Percussion comprising conga risers, which include four individual sturdy rubber or resiliently synthetic feet arranged underneath the bottom of a drum shell that function to raise and maintain the drum off the floor to allow maximum sound projection.

Another prior art device is a universal conga riser marketed under the trademark Gon Bops. Typically three individual risers, each equipped with a thumb screw-like mechanism, are employed around the bottom rim of the conga shell to hold the drum off the ground to enable maximum sound projection.

The improved drum stand of the present invention comprises a new and improved and most importantly effective means upon which congas and a wide variety of other ethnic drums of different sizes may be mounted and held suspended off the ground to provide maximum sound projection and an improved richness in tone.

Nothing in the prior art, including the cited references and the prior art described above, provides or even suggests a device with the combination of structural elements and relationship of components, and the specific means and objectives, as the improved device of the present invention.

SUMMARY OF THE INVENTION

The device of the present invention comprises a stand that supports a musical drum shell and suspends it off the ground or floor surface, which includes a base section defining an opening at the bottom. The support stand further includes a first member typically ring-shaped and a spaced-apart second member also typically ring-shaped situated below the first member. A plurality of spaced-apart brace support members are provided to join the first member to the second member with each of the brace support members being alternatively curved in concave-convex relation and adapted for detachably receiving and securely gripping the drum shell's base section and holding it in suspension off the ground.

Accordingly, the object of the present invention is to provide a new and improved musical drum stand for supporting a drum shell and suspending it off the ground to enable enhanced sound projection.

Another object of the present invention is to provide a new and improved musical drum stand for supporting a drum shell and suspending it off the ground that accommodates drum shells of different sizes.

Another object of the present invention is to provide a new and improved musical drum stand for supporting a drum shell and suspending it off the ground that is uncomplicated to use and easy to transport.

Still another object of the present invention is to provide a new and improved musical drum stand for supporting a drum shell and suspending it off the ground that is lightweight and easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
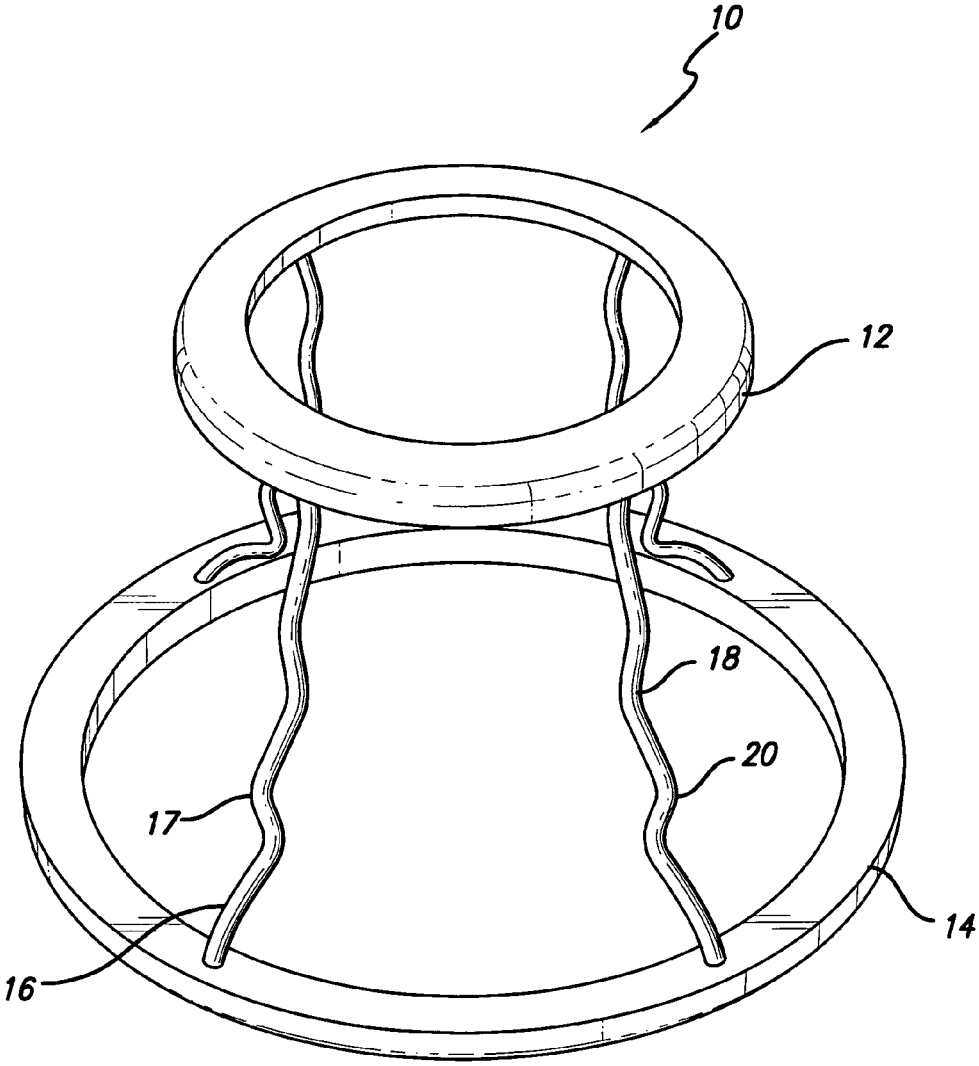
FIG. 1 is a perspective view of the musical drum support stand in accordance with the present invention.
Figure 2:
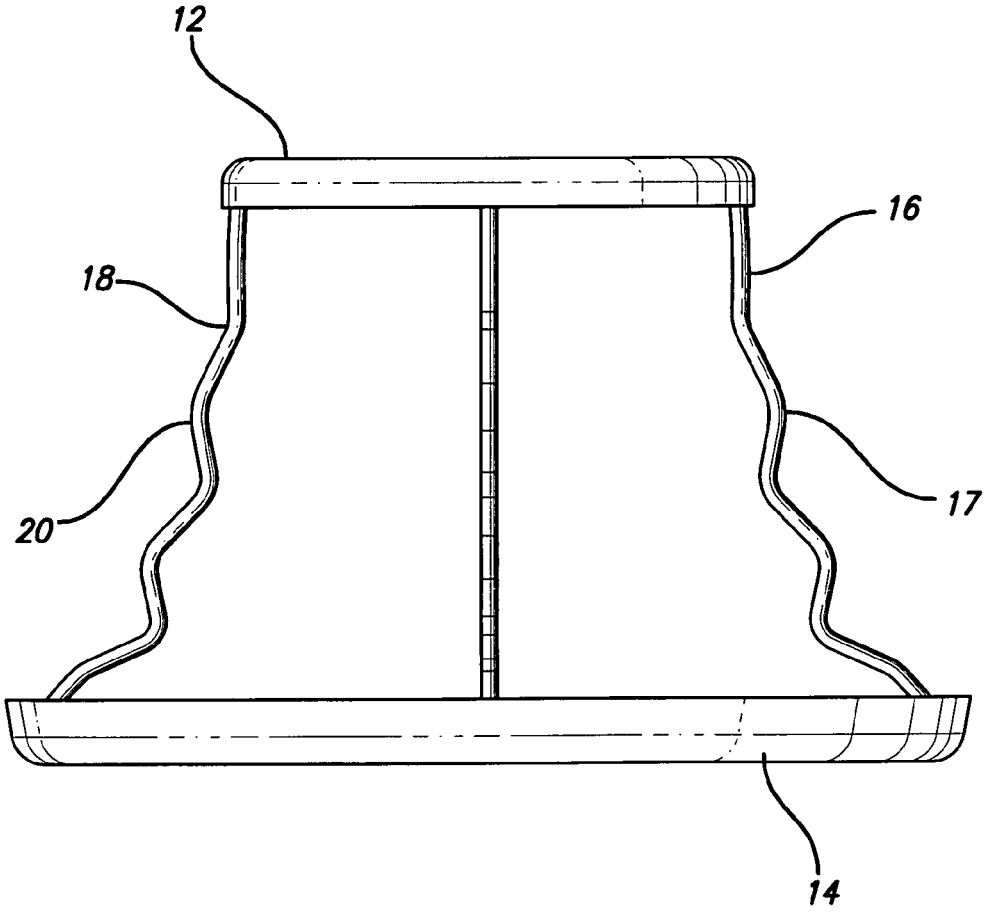
FIG. 2 is an elevational view of the musical drum support stand in accordance with the present invention.
Figure 3:
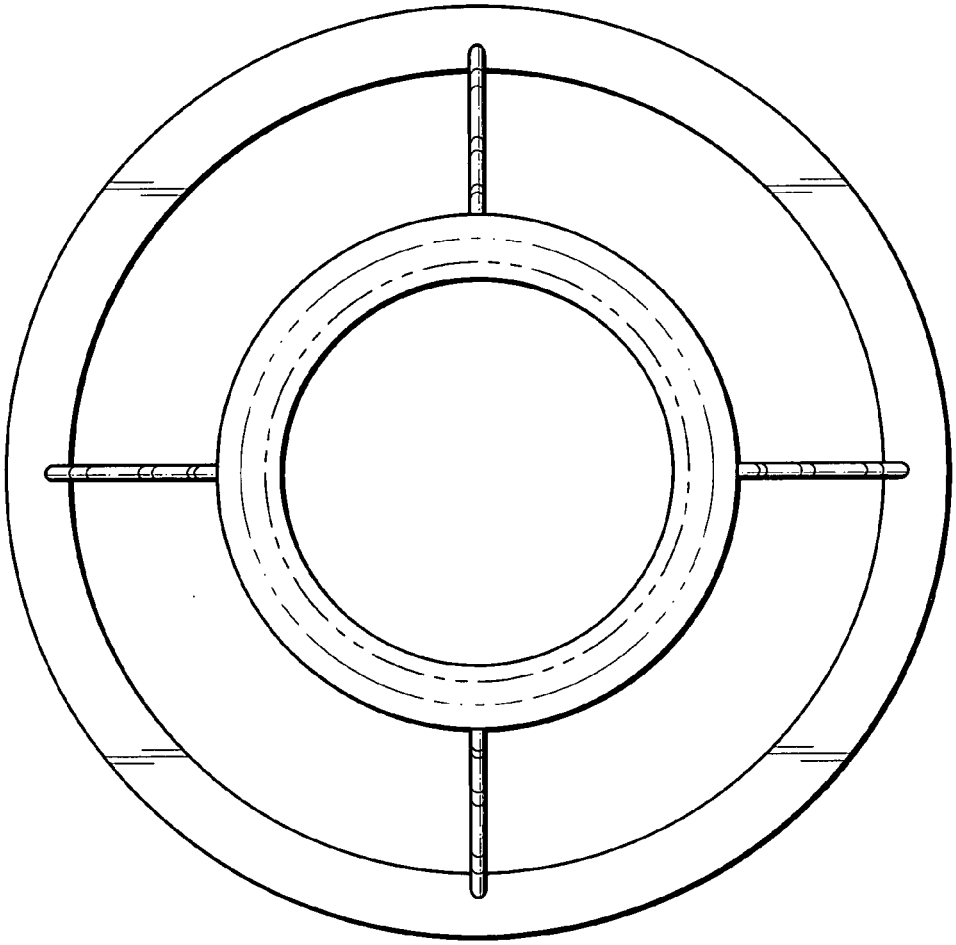
FIG. 3 is a top perspective view of the musical drum support stand in accordance with the present invention.
Figure 4:
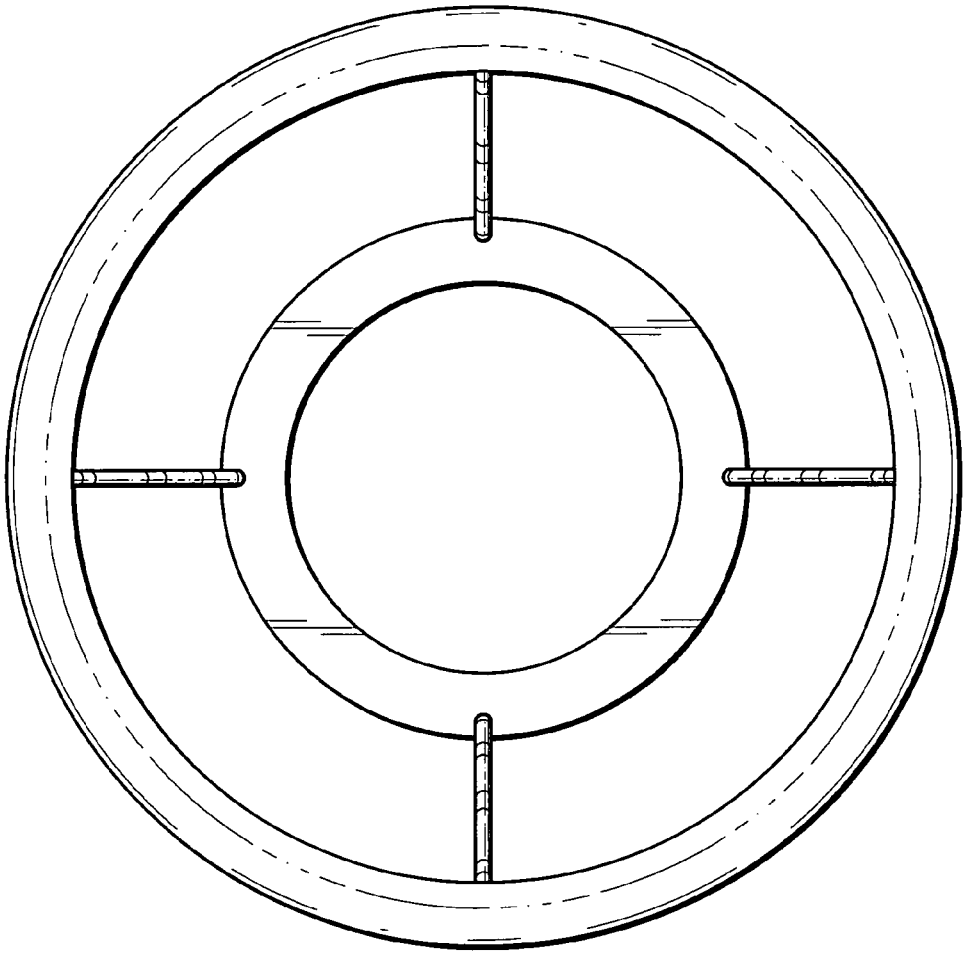
FIG. 4 is a bottom perspective view of the musical drum support stand in accordance with the present invention.
Figure 5:
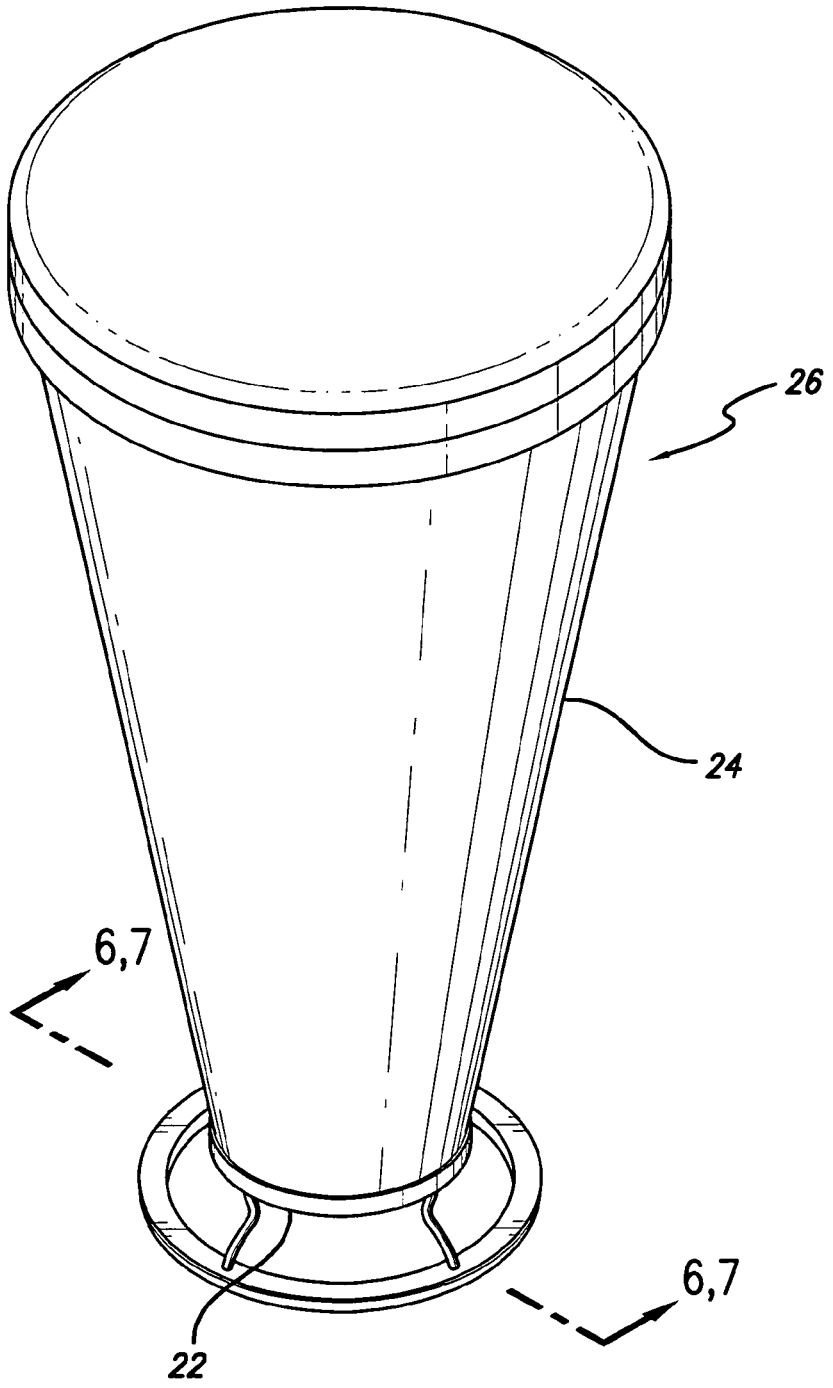
FIG. 5 is a view of the musical drum support stand in accordance with the present invention with a musical drum mounted thereon.
Figure 6:
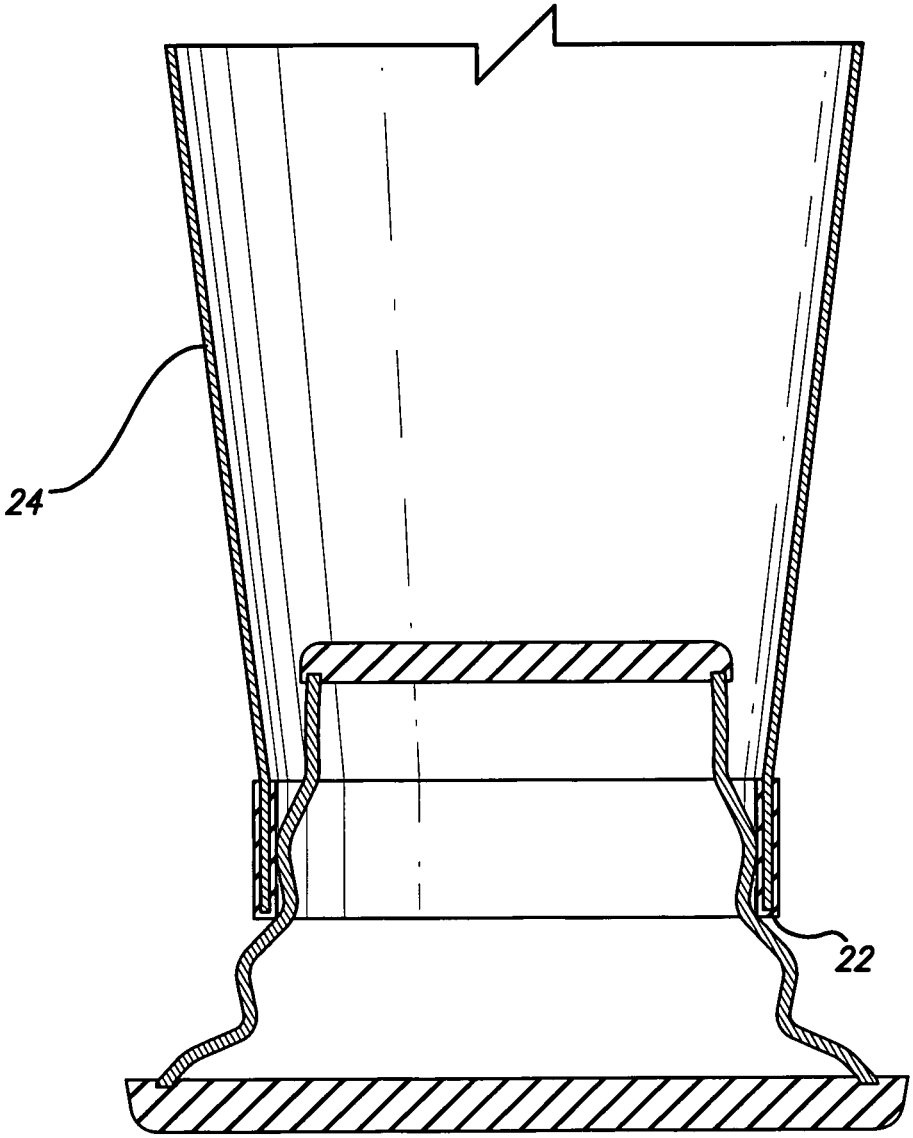
FIG. 6 is a cross-sectional view of the musical drum support stand in accordance with the present invention with a mounted musical drum shown along lines 6-6 of FIG. 5.
Figure 7:
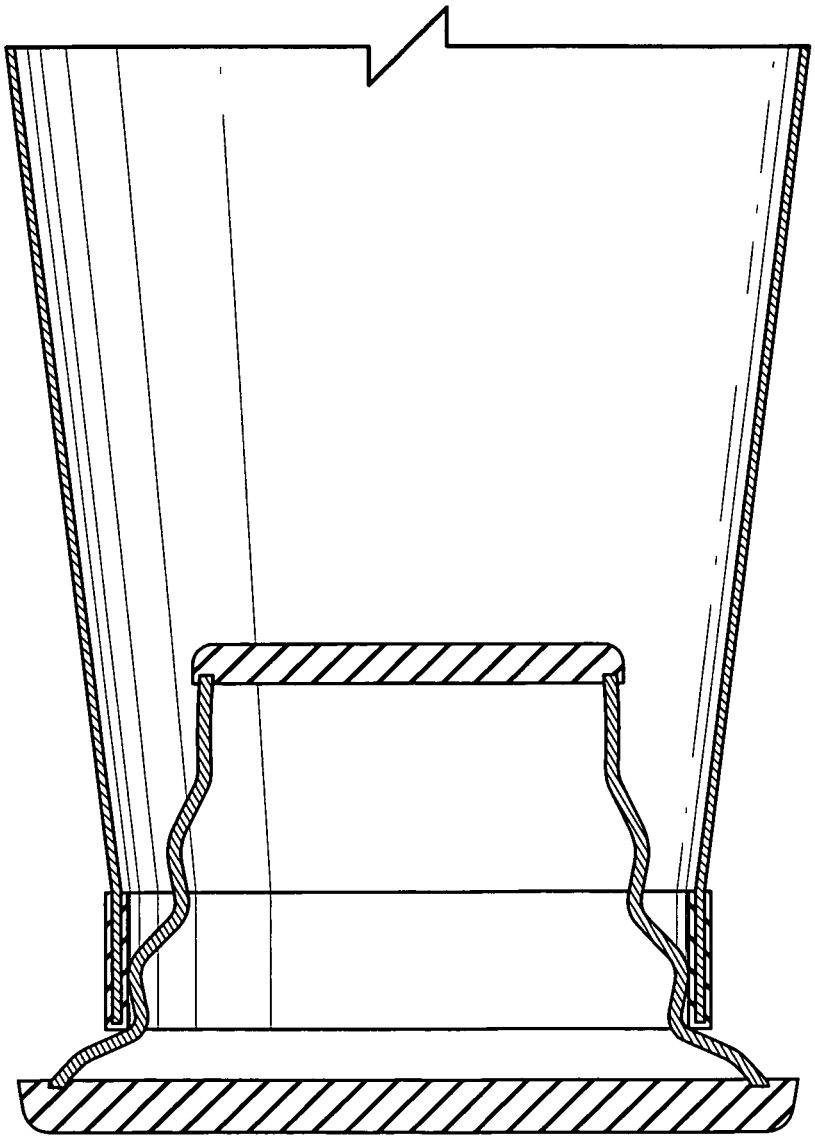
FIG. 7 is a cross-sectional view of the musical drum support stand in accordance with the present invention with a mounted musical drum having a shell of a different size than the drum shell in FIG. 6 shown along lines 7-7 of FIG. 5.

The present invention consists of a musical drum support stand 10 comprised of first member 12, which is preferably round or ring shaped, but which may also be configured differently, including, without limitation, as a rectangle, square or oval, and a second member 14, which is also preferably round or ring-shaped, but which also may be configured differently, including, without limitation, as a rectangle, square or oval. First member 12 and second member 14 are vertically spaced apart with second member 14 typically larger (if round or ring-shaped, for example, having a larger diameter) than first member 12.

A plurality of spaced-apart brace support members 16 are provided for joining first member 12 and second member 14. Each brace support member 16 is curved in concave-convex relation with concave sections 18 alternating with convex sections 20 to enable the bottom rim 22 of musical drum shell 24 to be detachably received and securely gripped while maintaining musical drum 26 suspended off the ground. At or near the terminus of each concave section 18, or at the approximate point where each concave section 18 transitions into a convex section 20, is a projecting shoulder 17 to provide further support for bottom rim 22. Musical drum support stand 10 can accommodate drum shells of different sizes, specifically with bottom rim 22 varying in diametrical dimension, or in a geometric dimension corresponding to any other particular shape, as described.

The usual dimensions of musical drum support stand 10 are, as follows: first member 12 is 5¼" in diameter; second member 14 is 9" in diameter; and, each brace support member 16 is 5" in length. These dimensions may vary, however, to accommodate drums with larger or smaller drum shells.

Support stand 10 may be made of any suitable material including, without limitation, resilient synthetics or a clad metal composite.

In a typical application of the present invention, support stand 10 is placed on the ground or on a floor surface and the musical drum 26 is lowered onto it until bottom rim 22 engages and grips brace support members 16 normally coming to rest on or near each shoulder 17. One of the many advantages that support stand 10 has over the prior art, particularly the Gon Bops and the Meinl Percussion devices, is the ability to suspend smaller drums at a height that maintains a more comfortable playing position for the drummer.

To lift musical drum 26 from support stand 10, the drummer need only to place his/her foot on second member 14 and then pull up on shell 24 to separate the two.

While the invention will be described in connection with a preferred embodiment, it is understood that it is not intended to limit the invention to that particular embodiment. Rather, it is intended to cover all alternatives, modifications and equivalents as may be included within the spirit and scope of the invention as defined by the appended claims.

The invention claimed is:

1. A stand for supporting a musical drum comprising a drum shell with a base section defining an opening, a first member; a second member vertically spaced-apart from said first member, said second member being larger than said first member; and a plurality of spaced-apart brace support members for joining said first member to said second member, each of said brace support members having sections that are alternatively curved in a concave/convex serpentine configuration for detachably receiving and securely gripping said base section.

2. The support stand of claim 1 wherein said drum shell is suspended off the ground.

3. The support stand of claim 1 wherein said first member and said second member are each annular in shape.

4. The support stand of claim 1 wherein said first member and said second member are each rectangular, square or triangular in shape.

5. The support stand of claim 1 wherein said first member is annular in shape.

6. The support stand of claim 1 wherein said first member is rectangular, square or triangular in shape.

7. The support stand of claim 1 wherein each of said spaced-apart brace support members has a plurality of said concave/convex serpentine sections.

8. The support stand of claim 1 wherein said spaced-apart brace support members diverge outwardly from said first member relative to said second member to form a connection below with said second member.

9. The support stand of claim 1 comprising a projecting shoulder section generally at or near the point where each said concave section transitions over to each said convex section for enhanced support of said drum shell.

* * * * *